US012319466B2

(12) United States Patent
Hutterer et al.

(10) Patent No.: US 12,319,466 B2
(45) Date of Patent: Jun. 3, 2025

(54) TRANSPORTING PACKAGING UNITS

(71) Applicants: Gerresheimer Glas GmbH, Düsseldorf (DE); Stevanato Group S.p.A., Piombino Dese (IT)

(72) Inventors: Nicole Hutterer, Wackersdorf (DE); Andreas Fraas, Amberg (DE); Ricardo Colchado, Corregidora (MX); Stephen Flynn, Peachtree City, GA (US); Braden Miller, Havertown, PA (US); Scott Rosenman, Mount Laurel, NJ (US); Alessio Bonati, Cadoneghe (IT); Michele Guasti, Treviso (IT); Marco Canestraro, Carmignano di Brenta (IT); Riccardo Prete, Ponte San Nicolo (IT); Gianpaolo Bertolin, Noale (IT); Michael-Martin Strehl, Pfreimd (DE)

(73) Assignees: Gerresheimer Glas GmbH, Düsseldorf (DE); Stevanato Group S.p.A., Piombino Dese (IT)

( * ) Notice: Subject to any disclaimer, the term of this patent is extended or adjusted under 35 U.S.C. 154(b) by 0 days.

(21) Appl. No.: 17/746,560

(22) Filed: May 17, 2022

(65) Prior Publication Data

US 2022/0371773 A1 Nov. 24, 2022

Related U.S. Application Data

(60) Provisional application No. 63/190,071, filed on May 18, 2021.

(51) Int. Cl.

| | |
|---|---|
| ***B65D 6/06*** | (2006.01) |
| ***B65B 5/06*** | (2006.01) |
| ***B65D 25/10*** | (2006.01) |

(52) U.S. Cl.
CPC ..... *B65D 11/12* (2013.01); *B65B 5/06* (2013.01); *B65D 25/108* (2013.01)

(58) Field of Classification Search
CPC ..... B65D 11/12; B65D 11/10; B65D 11/00; B65D 5/728; B65D 7/10; B65D 9/08; B65D 2583/0468; B65D 25/108
See application file for complete search history.

(56) References Cited

U.S. PATENT DOCUMENTS

| | | |
|---|---|---|
| 2,702,647 A | 2/1955 | Wesling |
| 4,105,407 A | 8/1978 | Sanderson |

(Continued)

FOREIGN PATENT DOCUMENTS

| | | |
|---|---|---|
| CN | 1726148 | 1/2006 |
| CN | 101237896 | 8/2008 |

(Continued)

OTHER PUBLICATIONS

Atkins, Nick, "Sterile Ready-to-Fill Components | Adelphi Healthcare Packaging", Nov. 28, 2012, pp. 1-1, Retrieved from the Internet: URL: https://adelphi-hp.com/news-events/sterile-ready-to-fill%C2%AE-components [retrieved on Sep. 23, 2022].

(Continued)

*Primary Examiner* — Javier A Pagan
(74) *Attorney, Agent, or Firm* — Fish & Richardson P.C.

(57) ABSTRACT

A transport assembly with a box portion including a box surface, a box front, a box back, and a pair of box sides, wherein the front, back, and sides each extend from the box surface, wherein a gap extends between the front and each of the sides; and a drawer portion including a drawer surface, a drawer front, and a pair of drawer sides, wherein the drawer front and drawer sides each extend from the drawer surface, the drawer surface and drawer sides define an open back portion that faces the drawer front, a gap (Continued)

extends between the drawer front and each of the drawer sides, and the box portion and drawer portion can be arranged such that an inner surface of the drawer front faces an outer surface of the box front and an inner surface of each box side faces an outer surface of a corresponding drawer side.

20 Claims, 14 Drawing Sheets

(56) References Cited

U.S. PATENT DOCUMENTS

| | | | | |
|---|---|---|---|---|
| 4,174,034 | A | 11/1979 | Hoo | |
| 4,457,432 | A | 7/1984 | Solheim | |
| 5,080,222 | A | 1/1992 | McNary | |
| 5,275,291 | A | 1/1994 | Sledge | |
| 5,372,787 | A | 12/1994 | Ritter | |
| 7,300,637 | B2 | 11/2007 | Lin et al. | |
| 7,708,142 | B2 * | 5/2010 | Ehrlund | B65D 5/38 206/528 |
| 7,823,725 | B1 | 11/2010 | Shupe | |
| 8,679,404 | B2 | 3/2014 | Liburd et al. | |
| 9,918,898 | B2 | 3/2018 | Fadeev et al. | |
| 9,938,042 | B1 * | 4/2018 | Aryanpanah | B65D 11/20 |
| 10,017,294 | B2 | 7/2018 | Deutschle et al. | |
| 10,703,539 | B2 | 7/2020 | Deutschle et al. | |
| 2002/0022246 | A1 | 2/2002 | Lin et al. | |
| 2003/0091471 | A1 | 5/2003 | Lacabanne | |
| 2003/0183547 | A1 | 10/2003 | Heyman | |
| 2003/0199082 | A1 | 10/2003 | Miller et al. | |
| 2004/0062692 | A1 | 4/2004 | Lin et al. | |
| 2006/0086638 | A1 | 4/2006 | Priebe et al. | |
| 2008/0236631 | A1 | 10/2008 | Lin et al. | |
| 2008/0317912 | A1 | 12/2008 | Keller et al. | |
| 2011/0094901 | A1 | 4/2011 | Ingvardsen et al. | |
| 2011/0296800 | A1 | 12/2011 | Clark et al. | |
| 2012/0211492 | A1 | 8/2012 | Kelly | |
| 2013/0169132 | A1 | 7/2013 | Johnson et al. | |
| 2013/0280134 | A1 | 10/2013 | Hoffman et al. | |
| 2014/0027326 | A1 | 1/2014 | Peruzzo | |
| 2014/0216059 | A1 | 8/2014 | Moore et al. | |
| 2015/0108034 | A1 | 4/2015 | Deutschle et al. | |
| 2015/0175304 | A1 | 6/2015 | Ficker | |
| 2016/0288126 | A1 | 10/2016 | Motadel et al. | |
| 2017/0073091 | A1 | 3/2017 | Deutschle et al. | |
| 2017/0225162 | A1 | 8/2017 | Liu et al. | |
| 2017/0247132 | A1 | 8/2017 | Deutschle et al. | |
| 2017/0333938 | A1 | 11/2017 | Brennan et al. | |
| 2018/0057249 | A1 | 3/2018 | Bertolin | |
| 2018/0116907 | A1 | 5/2018 | Fadeev et al. | |
| 2018/0208377 | A1 | 7/2018 | Kloke et al. | |
| 2018/0265263 | A1 | 9/2018 | Li | |
| 2019/0083697 | A1 | 3/2019 | Evans et al. | |
| 2019/0299217 | A1 | 10/2019 | Motadel et al. | |
| 2019/0343721 | A1 | 11/2019 | Komann et al. | |
| 2020/0147253 | A1 | 5/2020 | Spencer et al. | |
| 2020/0246223 | A1 | 8/2020 | Nicolas et al. | |
| 2022/0371760 | A1 | 11/2022 | Redeker et al. | |
| 2022/0371762 | A1 | 11/2022 | Rosenman et al. | |
| 2022/0371765 | A1 | 11/2022 | Hutterer et al. | |
| 2022/0371781 | A1 | 11/2022 | Hutterer et al. | |
| 2022/0371807 | A1 | 11/2022 | Hutterer et al. | |
| 2024/0286816 | A1 | 8/2024 | Hutterer et al. | |

FOREIGN PATENT DOCUMENTS

| | | | |
|---|---|---|---|
| CN | 101272811 | | 9/2008 |
| CN | 101336194 | A | 12/2008 |
| CN | 104271346 | | 1/2015 |
| CN | 104755604 | | 7/2015 |
| CN | 106347771 | | 1/2017 |
| CN | 106458416 | | 2/2017 |
| CN | 207045959 | U | 2/2018 |
| CN | 208761268 | U | 4/2019 |
| CN | 110481984 | A | 11/2019 |
| CN | 210285018 | U | 4/2020 |
| CN | 111655590 | A | 9/2020 |
| CN | 212654814 | U | 3/2021 |
| DE | 2952733 | | 7/1981 |
| DE | 9112325 | | 11/1991 |
| DE | 202012010704 | | 12/2012 |
| DE | 102013114404 | A1 | 6/2015 |
| DE | 102020206748 | | 12/2020 |
| EP | 0903176 | | 3/1999 |
| EP | 1780143 | | 5/2007 |
| EP | 3345587 | | 11/2011 |
| EP | 2408483 | | 1/2012 |
| EP | 2543391 | | 3/2016 |
| FR | 1277678 | A | 12/1961 |
| FR | 1439210 | A | 5/1966 |
| FR | 3020801 | A1 | 11/2015 |
| GB | 2056262 | A | 3/1981 |
| JP | H07-61445 | A | 3/1995 |
| JP | 2001112857 | | 4/2001 |
| JP | 2016196306 | A | 11/2016 |
| KR | 20000020817 | U | 12/2000 |
| KR | 20120006140 | U | 9/2012 |
| WO | WO 2010/106168 | | 9/2010 |
| WO | WO 2011/135085 | | 11/2011 |
| WO | WO 2014/130349 | | 8/2014 |
| WO | WO 2015/076780 | | 5/2015 |
| WO | WO 2017/044906 | | 3/2017 |
| WO | WO 2018/175985 | | 9/2018 |
| WO | WO 2021/050450 | A1 | 3/2021 |

OTHER PUBLICATIONS

Lavajo Nathalie et al: "Specifications—Vials and bottles for parenteral application Code: PC-00132 Revision : 08 Specifications Vials and bottles for parenteral application: Injectables Infusions Approval cycle", Oct. 16, 2019, pp. 1-25, Retrieved from the Internet: URL:https://www.sgd-pharma.com/sites/default/files/mediacenter/pc-00132_08_-_specifications_-_parenteral_application_vials_and_bottles_0.pdf [retrieved on Mar. 24, 2023].

Le Printing Machine Factory Limited: "How to Manufacture Glass Bottles", Sep. 10, 2016, Retrieved from the Internet: URL:https://www.youtube.com/watch?v=hGjYRaYjryI [retrieved on Mar. 24, 2023].

Manufacturing Chemist Redactor: "Pure, smooth and strong", Apr. 16, 2021, pp. 1-10, Retrieved from the Internet: URL:https://www.manufacturingchemist.com/news/article_page/Pure_smooth_and_strong/175981 [retrieved on Mar. 24, 2023].

Extended European Search Report in European Appln No. 22174021.0, dated Oct. 25, 2022, 9 pages.

Extended European Search Report in European Appln No. 22174019.4, dated Oct. 20, 2022, 8 pages.

Extended European Search Report in European Appln. No. 22174016.0, dated Oct. 17, 2022, 9 pages.

Extended European Search Report in European Appln. No. 22174017.8, dated Nov. 2, 2022, 6 pages.

Schott: "EVERIC smooth", Jan. 17, 2020, Retrieved from the Internet: URL:https://www.youtube.com/watch?v=niHtVIYbQaM [retrieved on Jun. 30, 2023].

Wang, "Science of Packaging Materials," China Light Industry Press, Feb. 28, 2017, pp. 188-189.

Dajun et al., "Application of papermaterials in the field of modeling design," Paper and PaperMaking, Jun. 5, 2003, 3:57-59 (Abstract Only).

Kegao et al., "Craftsman design of shipping packaging size (I)," ShanghaiPackaging, Jun. 28, 2016, 6:13-15 (Abstract Only).

Office Action in Canadian Appln. No. 3,159,084, mailed Dec. 11, 2024, 4 pages.

Office Action in Chinese Appln. No. 202210537983.7, mailed Oct. 15, 2024, 6 pages (with English Translation).

Office Action in Chinese Appln. No. 202210537983.7, mailed Oct. 31, 2024, 7 pages (with English Translation).

(56) References Cited

OTHER PUBLICATIONS

Xiao et al., "Roll-forming process and CAE analysis of drawer idler slide rail," Forging & Stamping Technology, 2010, ,35(2):31-34 (Abstract only).

* cited by examiner

TRANSPORTING PACKAGING UNITS

CROSS-REFERENCE TO RELATED APPLICATION

This application claims the benefit of priority to U.S. Provisional Patent Application No. 63/190,071, filed on May 18, 2021, which is hereby incorporated by reference in its entirety.

BACKGROUND

This disclosure relates to a transport assembly and a method of transporting packaging units.

In industrial contexts, products are generally transported and sold in packaging units. Packaging units can include vials, cartridges, ampoules, bottles, or pre-fillable syringes. In many industries, these different types of packaging units are collectively known as "primary packaging," i.e., the packaging that comes into direct contact with an end product. The end product may be a food product, a cosmetic product, or a pharmaceutical product. Primary packaging can undergo numerous manufacturing processes before being filled with the end product. During these processes, primary packaging is often processed in batches.

US 2017/0247132 A1 describes a supporting structure that comprises a box-shaped upper part and a box-shaped bottom part. The upper part has a flat rectangular bottom, two side walls, and a front and rear side wall that each protrude vertically from the bottom. The bottom part has a corresponding shape and comprises a flat rectangular bottom and two side walls, each of which projects perpendicularly from the bottom. The front and rear side walls of the upper part can be folded down and then forms a common plane together with the bottom, and are folded-up again for forming the box-shaped bottom part.

SUMMARY

Aspects of the present disclosure aim to alleviate problems associated with known transport assemblies.

According to a first general aspect of the present disclosure, a transport assembly includes a box portion that includes a box surface, a box front, a box back, and a pair of box sides, wherein the box front, the box back, and the box sides each extend from the box surface, wherein a gap extends between the box front and each of the box sides; and a drawer portion that includes a drawer surface, a drawer front, and a pair of drawer sides, wherein the drawer front and the drawer sides each extend from the drawer surface, wherein the drawer surface and drawer sides define an open back portion that faces the drawer front, wherein a gap extends between the drawer front and each of the drawer sides, wherein the box portion and the drawer portion can be arranged such that an inner surface of the drawer front faces an outer surface of the box front and an inner surface of each box side faces an outer surface of a corresponding drawer side. The transport assembly according to the present disclosure may enclose a plurality of packaging units from all sides to group, transport, and protect the packaging units.

Each box side may releasably latch to a corresponding drawer side. For example, the outer surface of each drawer side may include one or more hooks, and the inner surface of each box side may include one or more indentations configured to releasably engage the one or more hooks. The hook may extend along a length of the drawer side. Each box side may include a plurality of indentations that are spaced along a height of the box side.

The drawer front may releasably latch to the box front. The outer surface of the box front may include a hook, and the inner surface of the drawer front may include one or more indentations configured to releasably engage the hook. The inner surface of the drawer front may include a plurality of indentations that are spaced along a height of the drawer front. The drawer front may include two or more tabs that releasably engage the gap that extends between the box front and each of the box sides.

The box front, the box back, and the box sides may each form an obtuse angle relative to the box surface. The drawer front and the drawer sides may each form an obtuse angle relative to the drawer surface.

The transport assembly may further include an insert that defines a plurality of openings, each opening configured to receive a packaging unit. each insert opening may have a substantially hexagonal shape. The insert may include a flexible material and is configured to expand and collapse.

The drawer surface may include one or more ridges that substantially extend along the length of the drawer surface.

One or both drawer sides may include one or more apertures that extend through a thickness of the drawer side and are arranged adjacent to the drawer surface.

According to a second general aspect of the present disclosure, a method includes receiving a box portion that includes a box surface, a box front, a box back, and a pair of box sides, wherein the box front, the box back, and the box sides each extend from the box surface, wherein a front gap extends between the box front and each of the box sides; arranging a plurality of packaging units in the box portion; receiving a drawer portion that includes a drawer surface, a drawer front, and a pair of drawer sides, wherein the drawer front and the drawer sides each extend from the drawer surface, wherein the drawer surface and drawer sides define an open back portion that faces the drawer front, wherein a drawer gap extends between the drawer front and each of the drawer sides; and arranging the drawer portion relative to the box portion such that an inner surface of the drawer front faces an outer surface of the box front and an inner surface of each box side faces an outer surface of a corresponding drawer side.

Arranging the plurality of packaging units in the box portion may include receiving an insert that defines a plurality of openings, each opening configured to receive a respective container and having a substantially hexagonal opening; laying the insert inside the box portion; and arranging one of the plurality of packaging units in each insert opening.

The method may include placing drawer surface on a supported surface; sliding the drawer portion away from the box portion while the box portion is held in place; and lifting the box portion, and optionally the insert, from the plurality of packaging units.

These and other embodiments described herein may provide one or more of the following benefits. The transport assembly may be made of a rigid or semi-rigid material (e.g., plastic) to protect the packaging units stored in the transport assembly. The transport assembly may be configured to accommodate packaging units of varying heights. The transport assembly may increase the density with which packaging units can be loaded in a transport assembly. The same transport assembly can be used to load packaging units facing in different directions. The transport assembly may unload a plurality of packaging units at the same time. The transport assembly may be suitable for both manual and automated loading and unloading. The components of the transport assembly may be designed to be reusable.

DESCRIPTION OF THE DRAWINGS

Certain embodiments will now be described, by way of example only, with reference to the accompanying drawings, in which.

Like reference numbers and designations in the various drawings indicate like elements.

DETAILED DESCRIPTION

Figure 1:
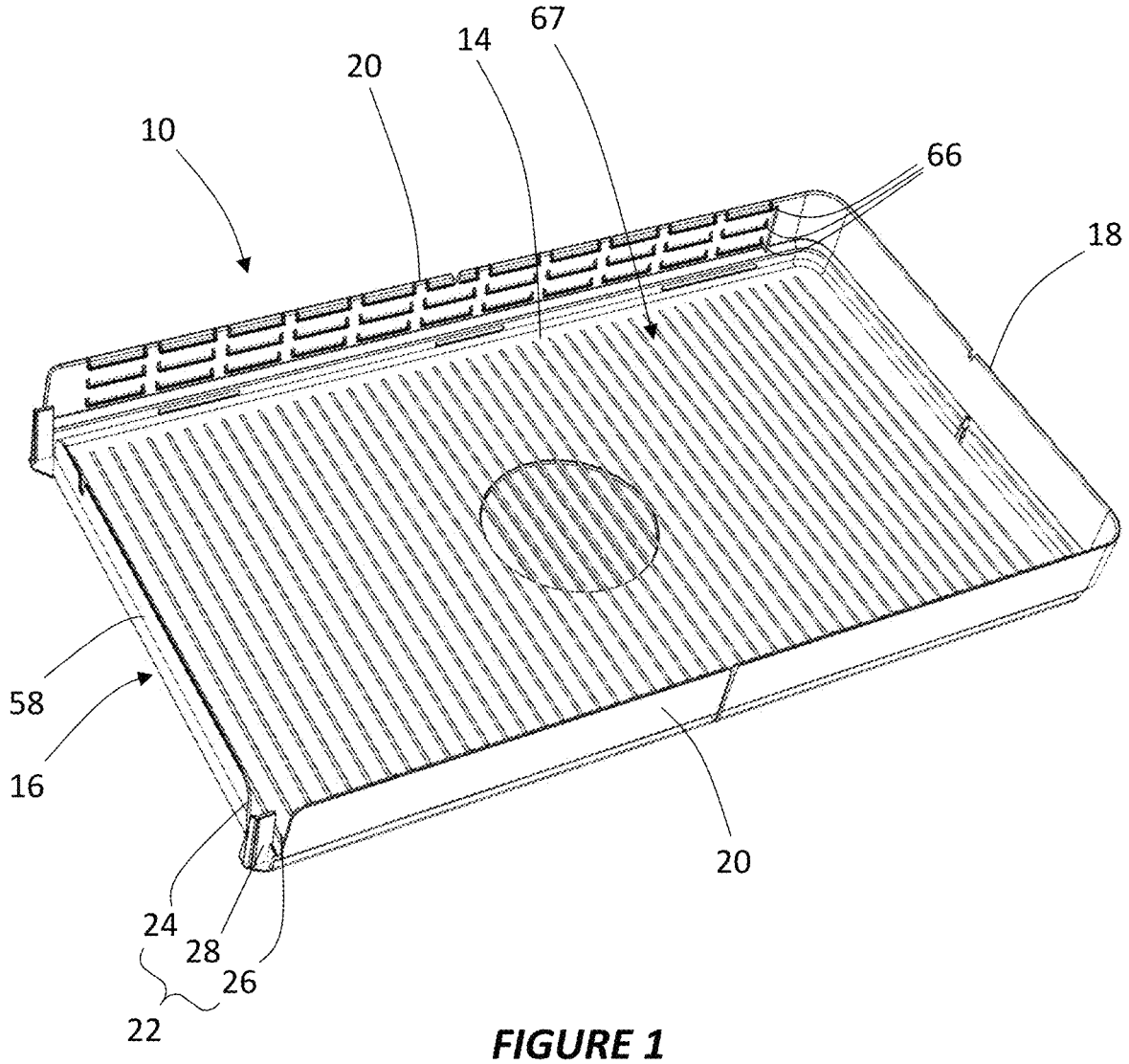
FIG. 1 is a perspective view of an example box portion for a transport assembly according to the present disclosure.
Figure 6:
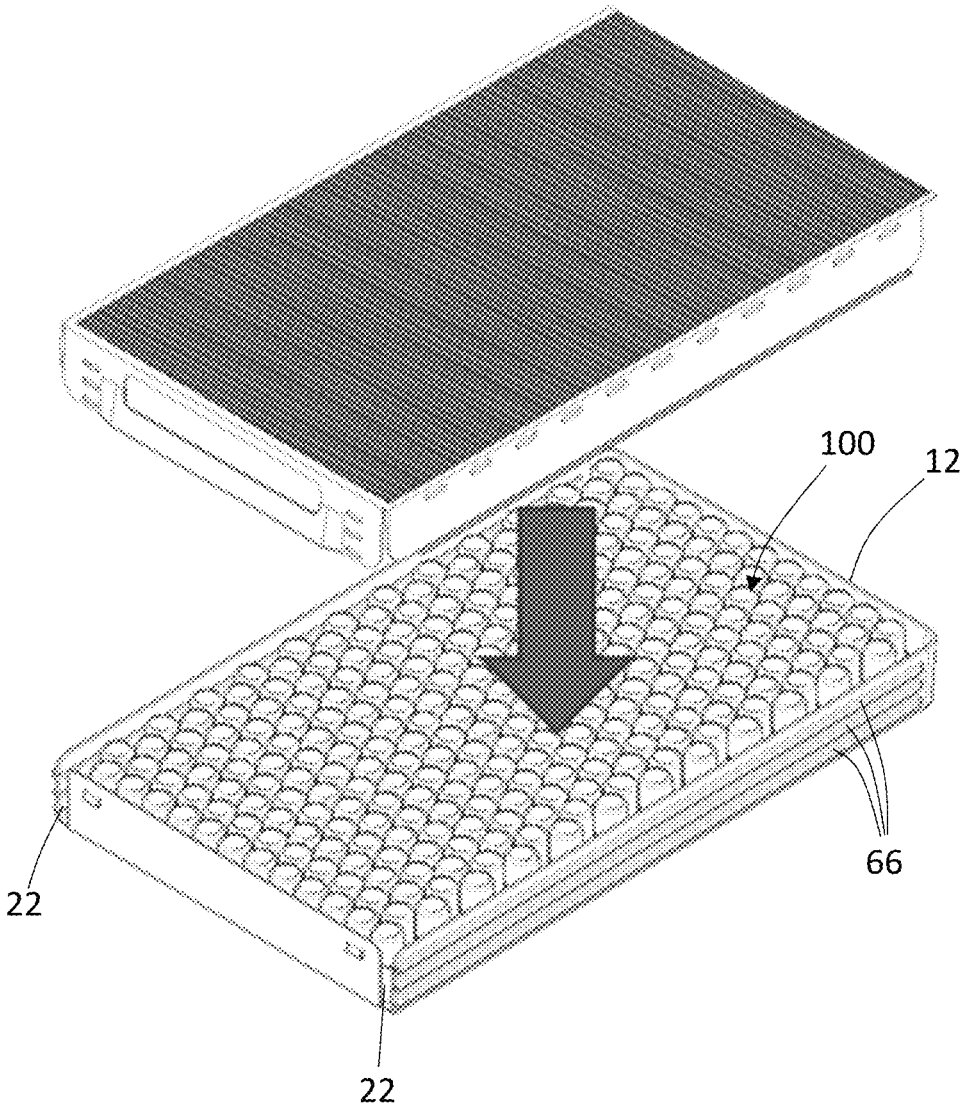
FIG. 6 shows an example transport assembly according to the present disclosure.

FIG. 1 shows a box portion 12 for a transport assembly 10 according to the present disclosure. The box portion 12 includes a box surface 14, a box front 16, a box back 18, and a pair of box sides 20. The box front 16, the box back 18, and the box sides 20 each extend from the box surface 14. A gap 22 extends between the box front 16 and each of the box sides 20. As shown in FIG. 1, the gap 22 includes a first gap section 24 and a second gap section 26 that are arranged on either side of a corner post 28. In some instances, the gap 22 can include a single section, as shown in FIG. 6, for example. The box portion 12 is designed to cooperate with a drawer portion 30 to form the transport assembly 10.

Figure 2:
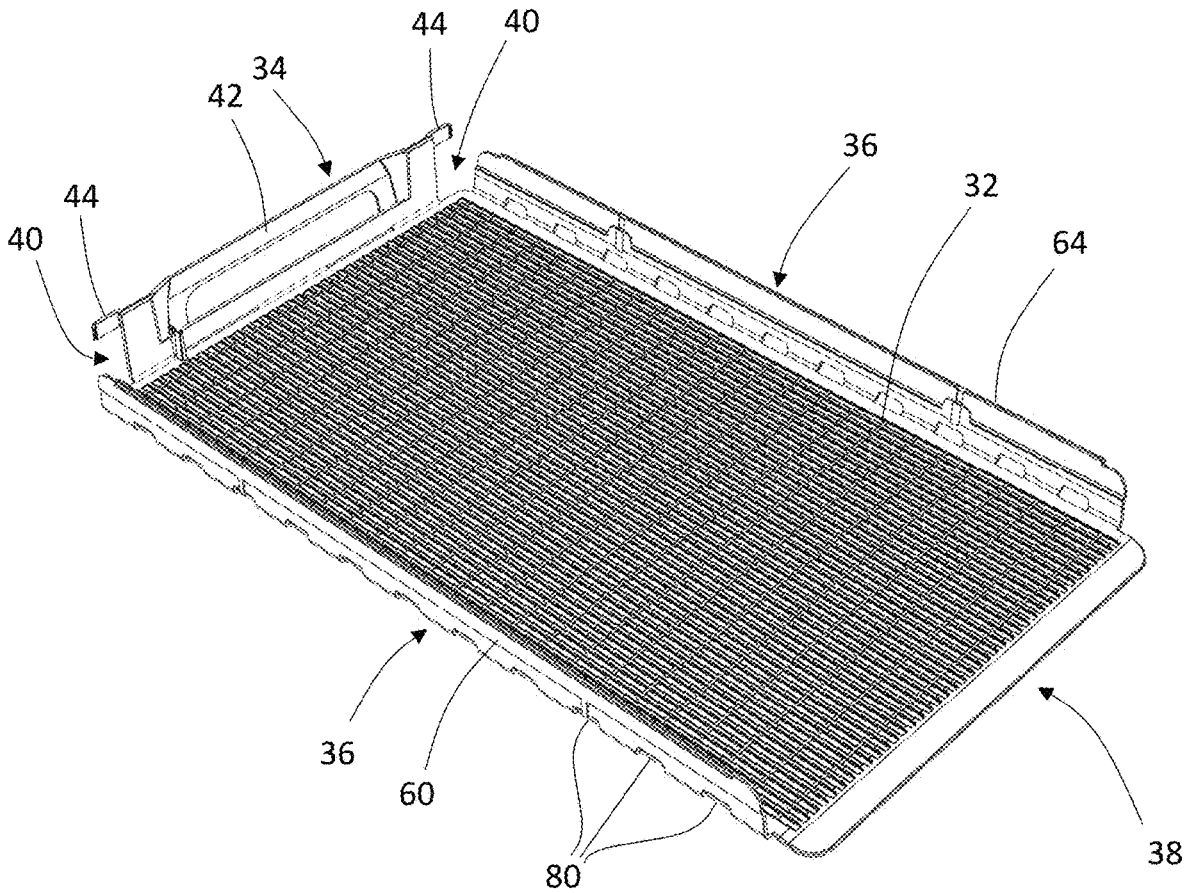
FIG. 2 is a perspective view of an example drawer portion for a transport assembly according to the present disclosure.

As shown in FIG. 2, the drawer portion 30 includes a drawer surface 32, a drawer front 34, and a pair of drawer sides 36. The drawer front 34 and the drawer sides 36 each extend from the drawer surface 32. The drawer surface 32 and drawer sides 36 define an open back portion 38 that faces the drawer front 34. When viewed from above, the drawer front 34 and the drawer sides 36 can form a U-shape. A gap 40 extends between the drawer front 34 and each of the drawer sides 36. The drawer front 34 includes an aperture that forms a handle 42 and a pair of side tabs 44 that couple to the box portion 12, as shown, e.g., in FIG. 7.

When the box portion 12 and the drawer portion 30 are coupled, they form a transport assembly 10, e.g., for a plurality of packaging units. The transport assembly 10 can be used as secondary packaging for primary packaging in the food, cosmetic, or pharmaceutical industries, i.e., packaging that groups, stores, and protects primary packaging. Although the expression "primary packaging" can encompass vials, cartridges, ampoules, bottles, and syringes to name a few examples, the following description will refer to "vials" for all types of primary packaging.

Figure 3:
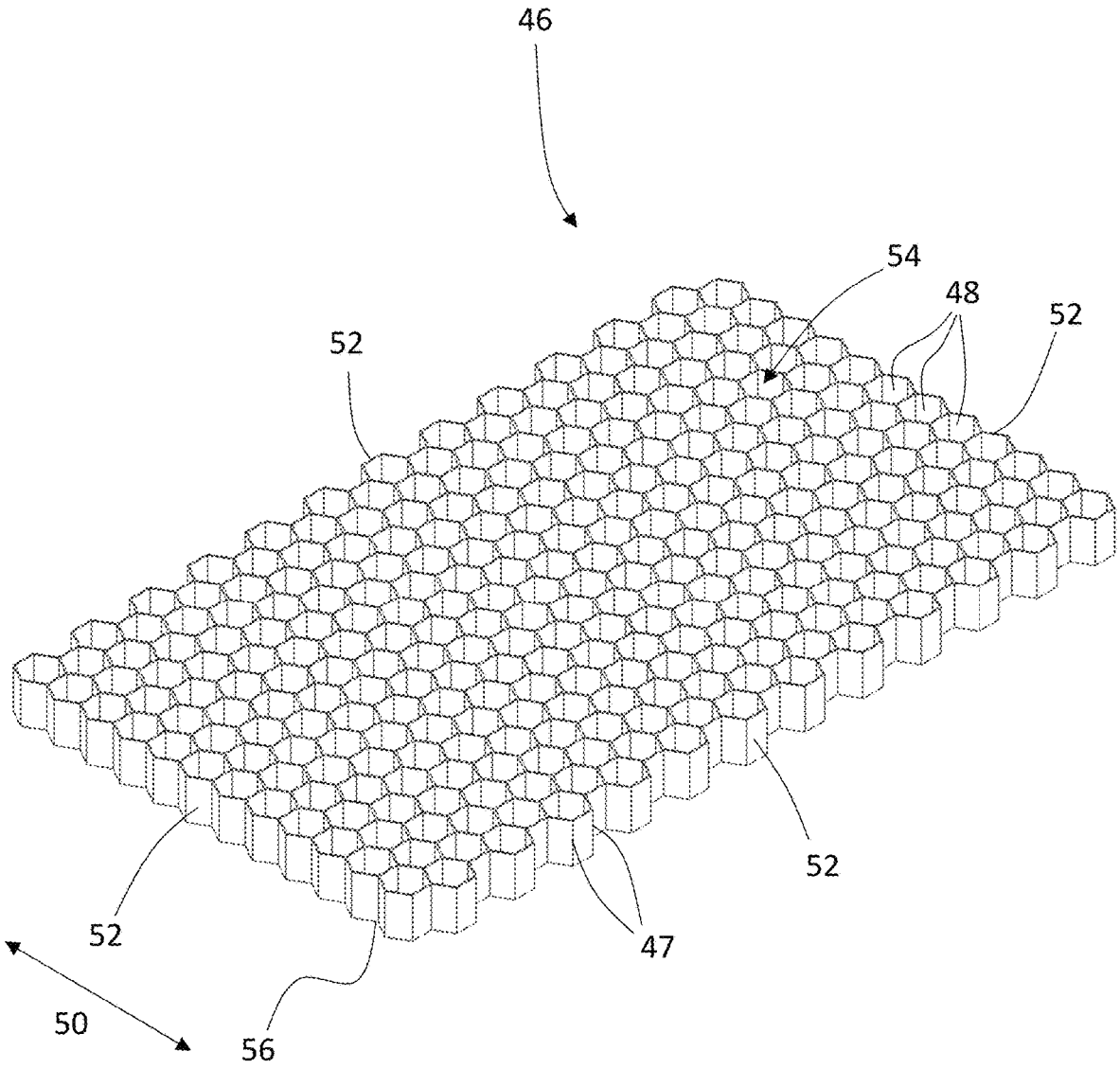
FIG. 3 is a perspective view of an example insert for a transport assembly according to the present disclosure.
Figure 5:
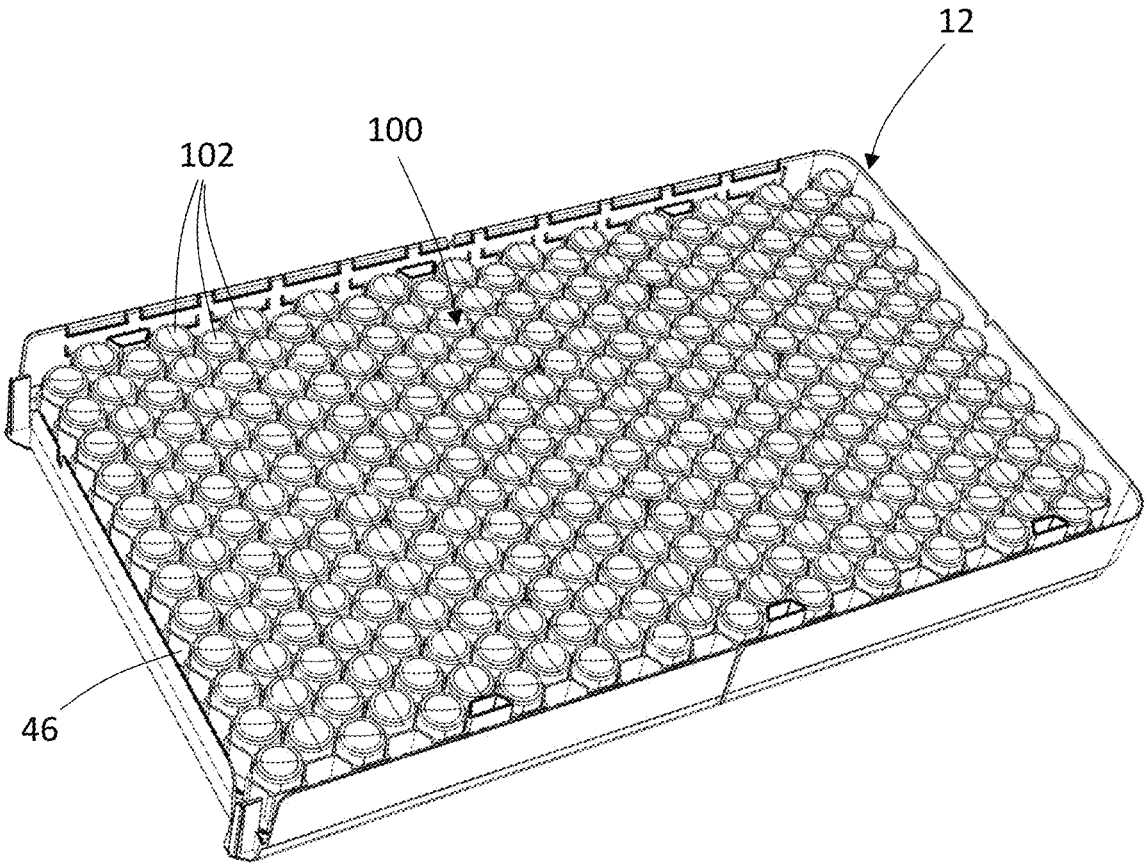
FIG. 5 shows the box portion and insert of FIG. 4 with a plurality of vials.

Although the vials can be loaded in the transport assembly 10 without any additional structures, FIG. 3 shows an example of an insert 46 that can be arranged in the transport assembly 10 to support the vials stored in the transport assembly 10. Generally speaking, the insert 46 defines a plurality of openings 48. Each opening 48 is configured to receive a vial (FIG. 5). In the illustrated form, each insert opening 48 has a substantially hexagonal shape. Thus, the insert 46 can be said to have a "honeycomb structure." The insert 46 may be made of a flexible material and expand and collapse in the direction of arrow 50. In other instances, the insert 46 can include substantially circular openings, for example.

Figure 4:
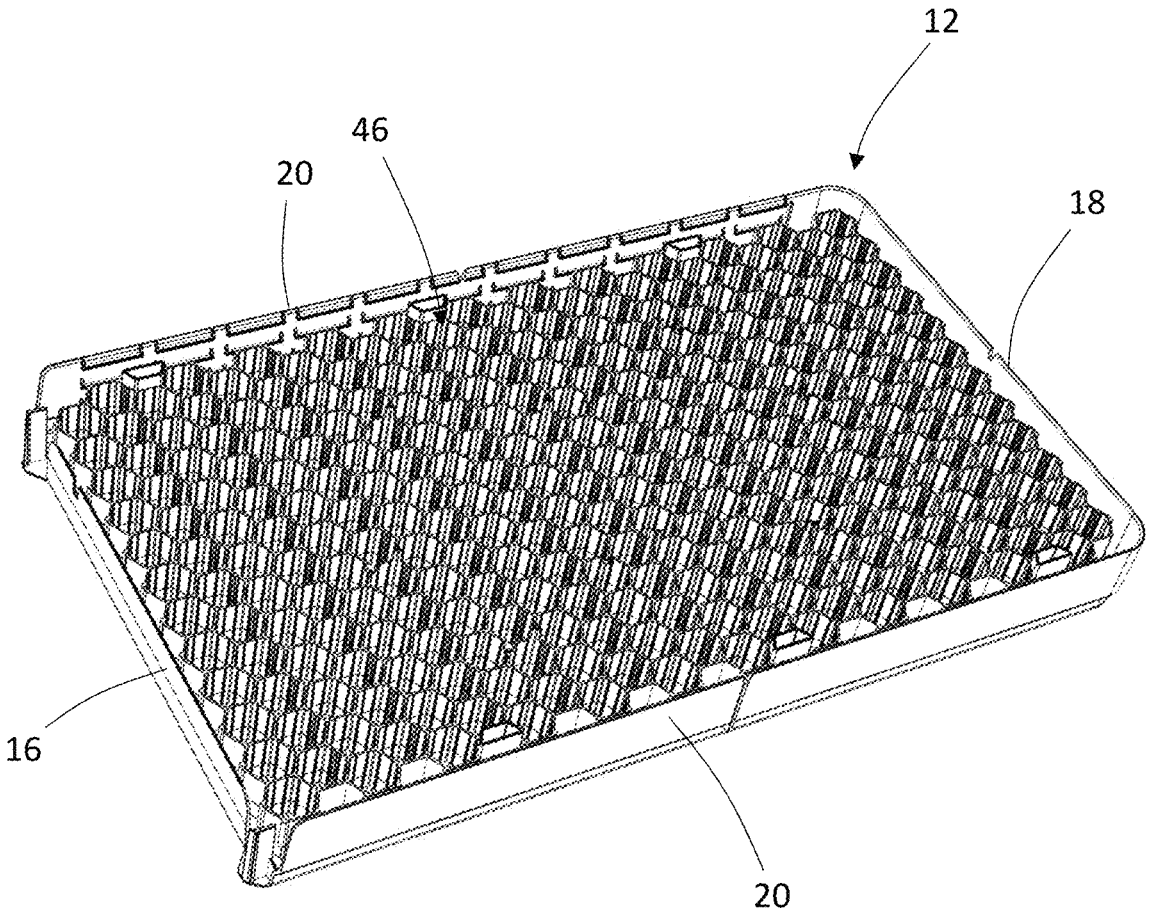
FIG. 4 shows the insert of FIG. 3 arranged in the box portion of FIG. 1.

FIG. 4 shows the honeycomb insert 46 arranged in the box portion 12. More specifically, the honeycomb insert 46 is arranged with the plurality of insert openings 48 arranged facing the box surface 14. The honeycomb insert 46 can be designed to be substantially the same size as the box surface 14. In other words, sides 52 (FIG. 3) of the honeycomb insert 46 may abut inner surfaces of the box front 16, the box back 18, and the box sides 20. When used in the transport assembly 10, the honeycomb insert 46 (or any alternative insert) may keep the vials stored in the transport assembly 10 in an upright position and prevent contact between the individual vials. Such separation of the vials can be useful, e.g., when the vials are made out of glass.

In some instances, vertical ribs 47 may be integrally formed along the sides 52 of the honeycomb insert 46, for example at the corners of the honeycomb shape (FIG. 3) or along the faces of the honeycomb. When the insert 46 is arranged in the box portion 12, such ribs 47 may abut the inner surfaces of the box front 16, the box back 18, and the box sides 20. The ribs 47 may center the honeycomb insert 46 within the transport assembly 10 and prevent the insert 46 from being crushed when the support assembly 10 is placed at the bottom of a stack of assemblies filled with vials.

Referring again to FIG. 3, the honeycomb insert 46 can be designed so that the insert openings 48 extend from one side 52 of the honeycomb insert 46 to the other. Thus, little space within the transport assembly 10 is lost to the insert 46. The honeycomb insert 46 can support and protect vials within the transport assembly 10 without substantially reducing the number of vials that can be received in the transport assembly 10.

Figure 9:
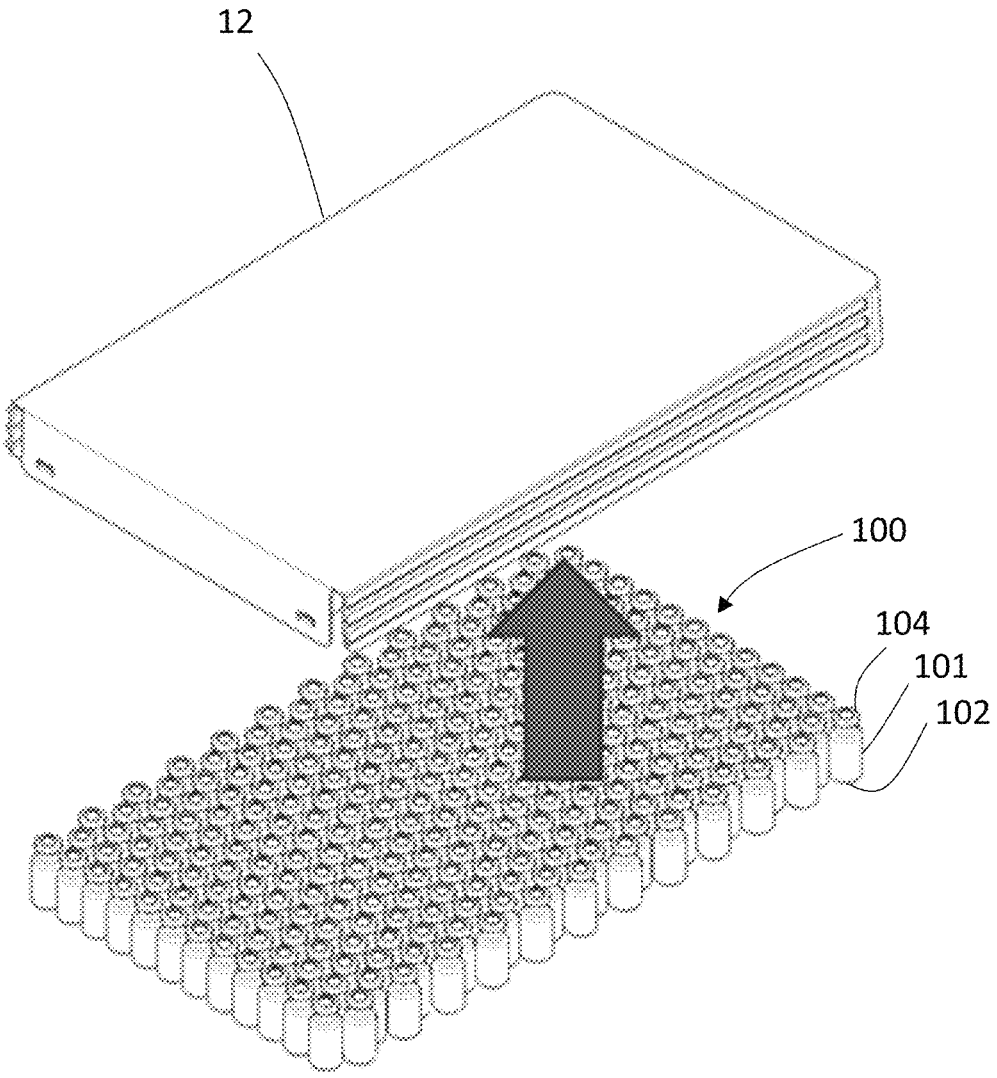
FIG. 9 shows the vials being unloaded from the transport assembly of FIGS. 6 and 8.

FIG. 5 shows the box portion 12 and the honeycomb insert 46 with a plurality of vials 100 arranged in the respective insert openings 48 of the honeycomb insert 46. Generally speaking, a vial 100 can have a substantially cylindrical body 101, a closed bottom end 102, and an open end 104 (FIG. 9). In some instances, the honeycomb insert 46 is designed so that its top and bottom surfaces 54, 56 (FIG. 3) are identical. Thus, the honeycomb insert 46 can be inserted in the box portion 12, and the vials 100 can be inserted with the bottom ends 102 up, as shown in FIG. 5, or with the open ends up 104.

Once the vials 100 have been loaded in the box portion 12, the drawer portion 30 can be placed on top of the box portion 12, as shown by the downward arrow in FIG. 6. Although the box portion 12 and the drawer portion 30 of FIG. 6 differ from those shown in FIGS. 1 to 5, the way of connecting the box portion 12 and the drawer portion 30 is the same for both designs.

Figure 7:
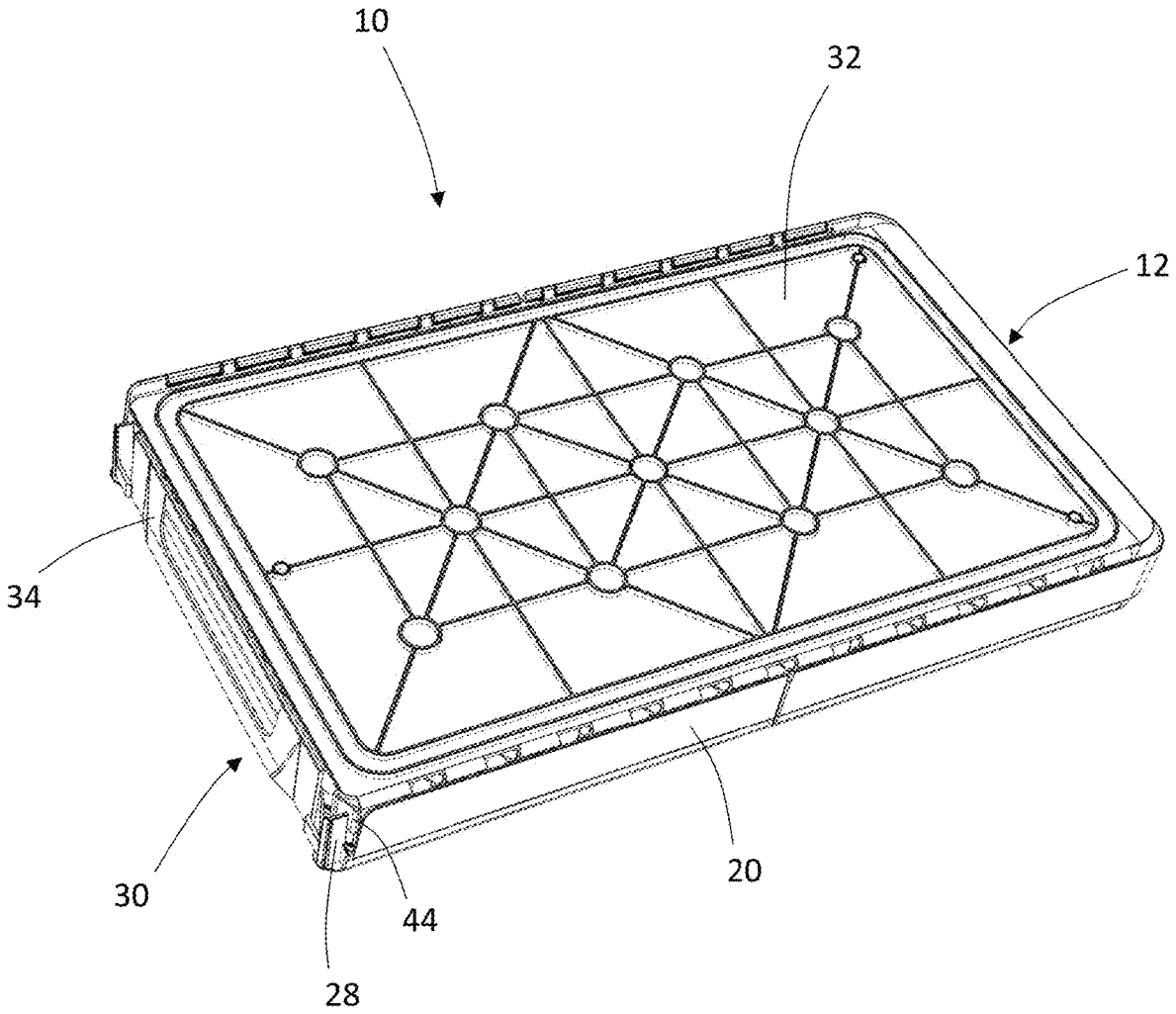
FIG. 7 shows a further example transport assembly according to the present disclosure.

FIG. 7 shows a transport assembly 10 that includes the box portion 12 and the drawer portion 30 of FIGS. 1 to 5.

Specifically, the box portion 12 and the drawer portion 30 are arranged such that an inner surface of the drawer front 34 faces an outer surface 58 of the box front 16 (FIG. 1) and an inner surface of each box side 20 faces an outer surface 60 of a corresponding drawer side 36 (FIG. 2). In the configuration shown in FIG. 7, the box front 16, the drawer front 34, the box sides 20, and the drawer sides 36 form a nested structure that encloses the plurality of vials 100. The gaps 22, 40 in the box portion 12 and the drawer portion 30 permit the respective surfaces to be nested in this manner. The box surface 14 and the drawer surface 32 can form the top and bottom surfaces of the transport assembly 10. For example, the transport assembly 10 of FIG. 7 may be placed in a sterile outer bag for further transport and handling.

Figure 8:
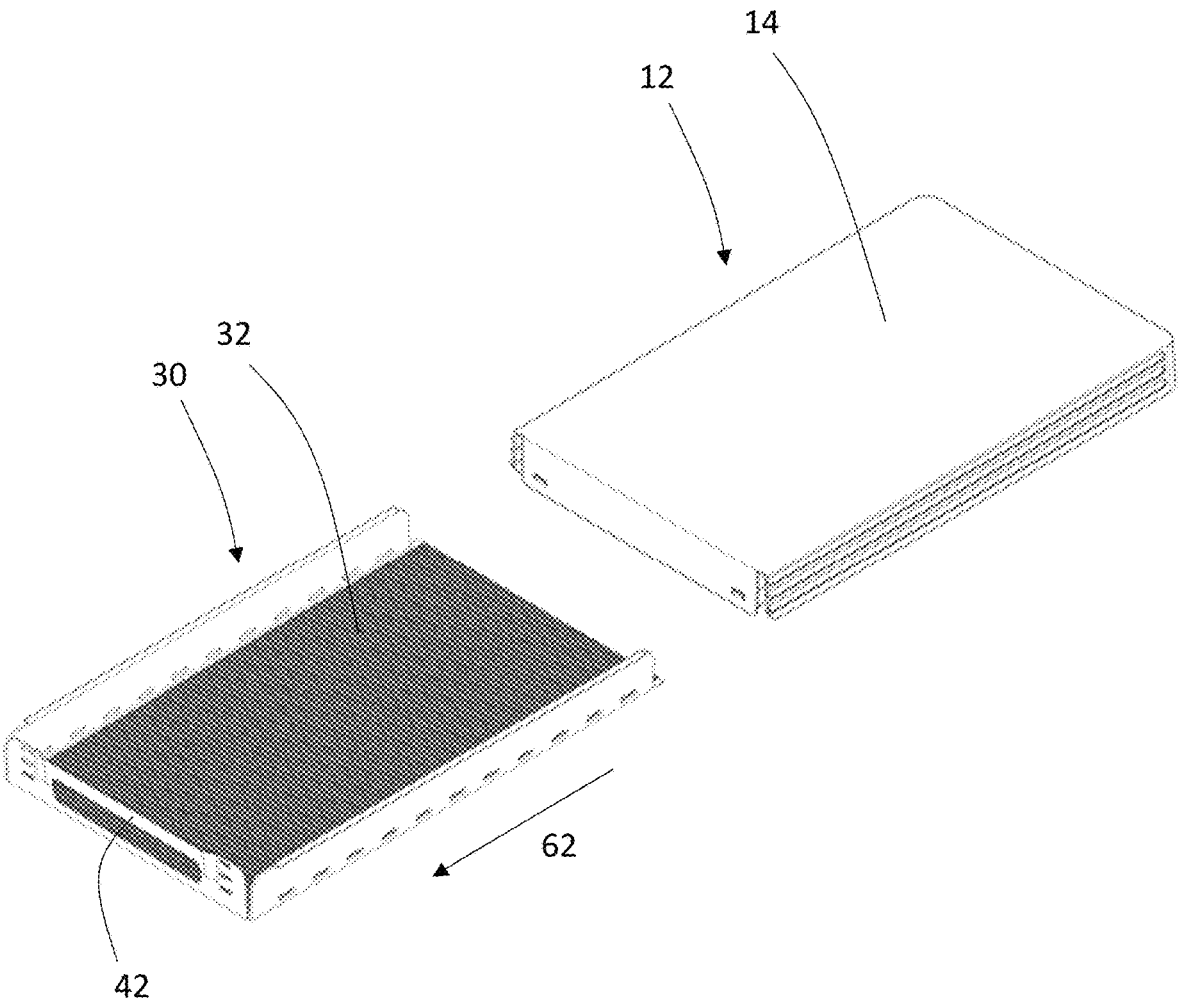
FIG. 8 shows the transport assembly of FIG. 6 being opened.

FIG. 8 shows how the vials 100 may be unloaded from the transport assembly 10 in some instances. The drawer portion 30 can be grasped by the handle 42 and pulled away from the box portion 12 in the direction of arrow 62. The vials 100 remain housed in the box portion 12 and can be secured by applying a light downward pressure to the box surface 14. In some instances, the drawer surface 32 can include a low-friction material that easily slides across the vials as the drawer portion 30 is moved in the illustrated manner (see also FIG. 2).

As shown in FIG. 9, the box portion 12 and, if included, the honeycomb insert 46 can be lifted off the vials 100 in a single movement, as indicated by the upward arrow. In FIG. 9, the vials 100 are shown with their open ends 104 facing upwards. As previously described, the vials 100 were loaded into the box portion 12 with their bottom ends 102 facing upwards (see FIG. 5). In order to unload the vials 100 in this orientation, the transport assembly 10 shown in FIG. 7 can be "flipped" so that the drawer portion 30 is positioned at the bottom of the transport assembly 10.

Figure 11A:
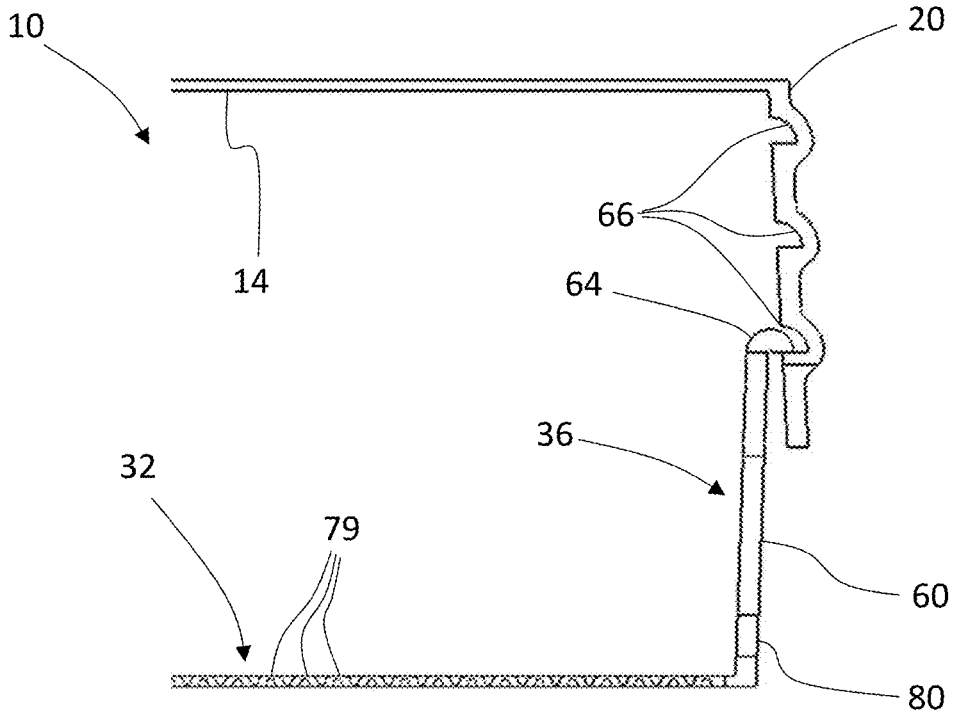
Figure 11B:
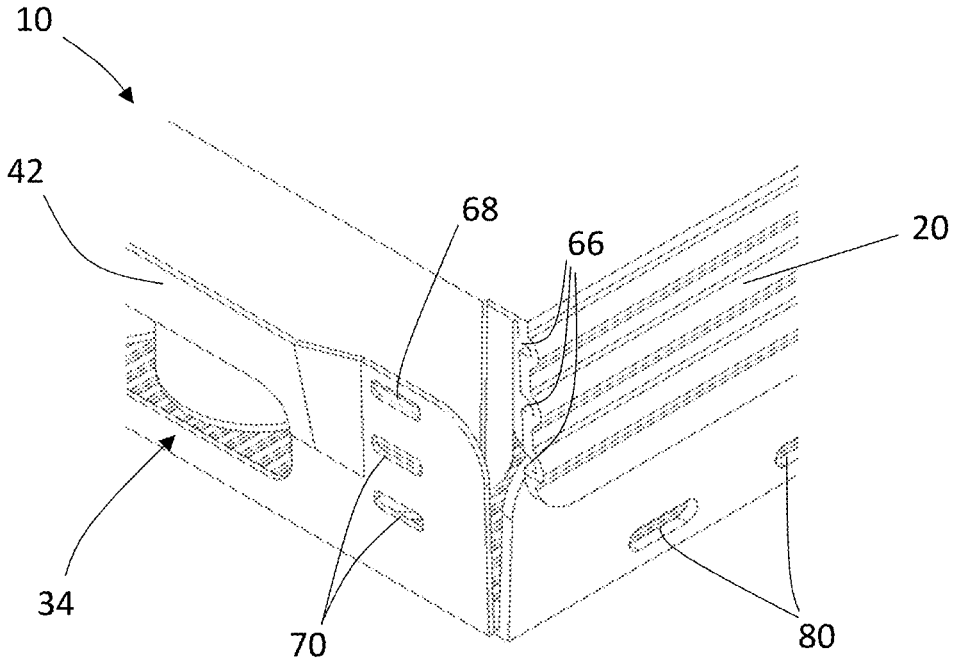
Figure 12:
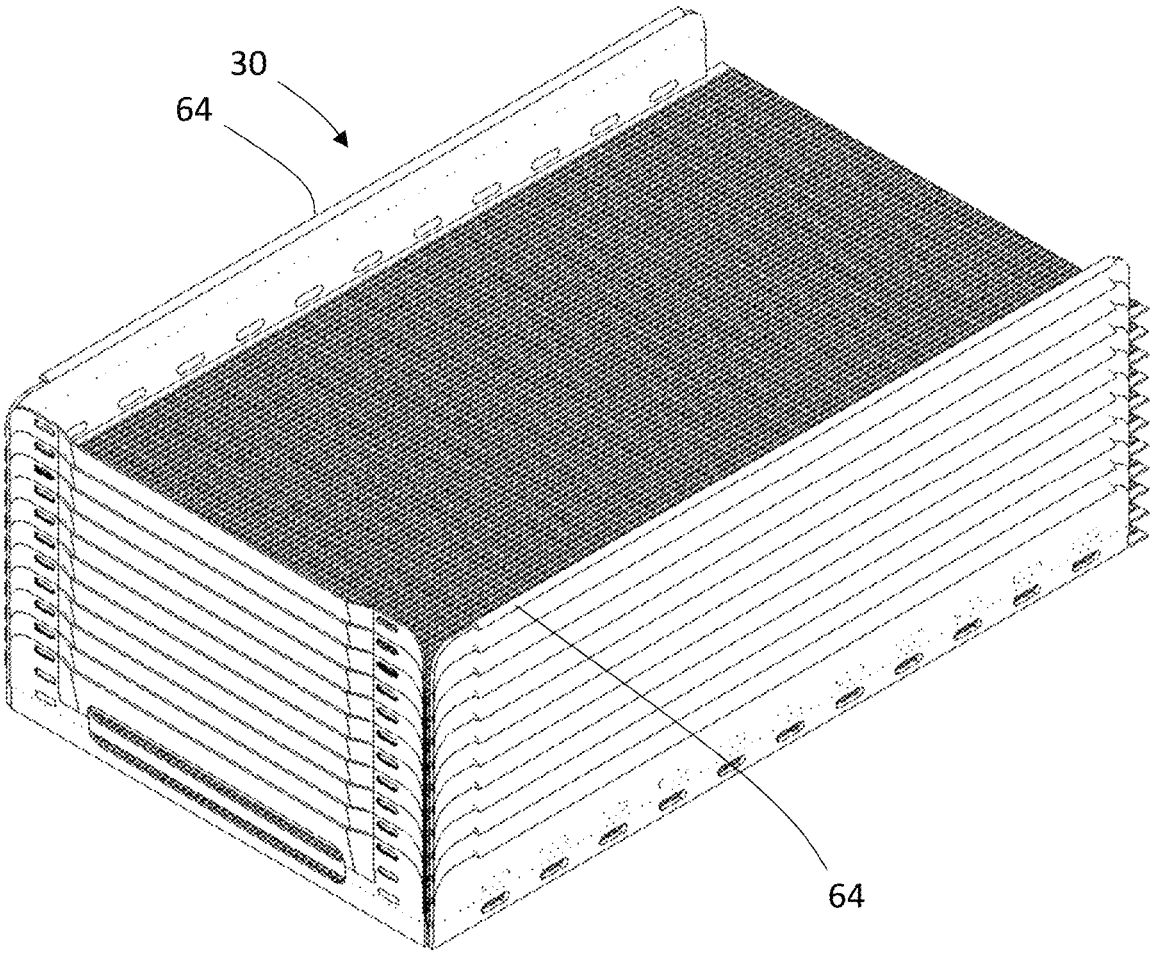
FIG. 12 shows a stack of drawer portions.

In order to secure the transport assembly 10, e.g., when it is flipped to unload the vials, each box side 20 can releasably latch to a corresponding drawer side 36. Examples of such latches are shown in FIGS. 10 to 12.

Figure 10A:
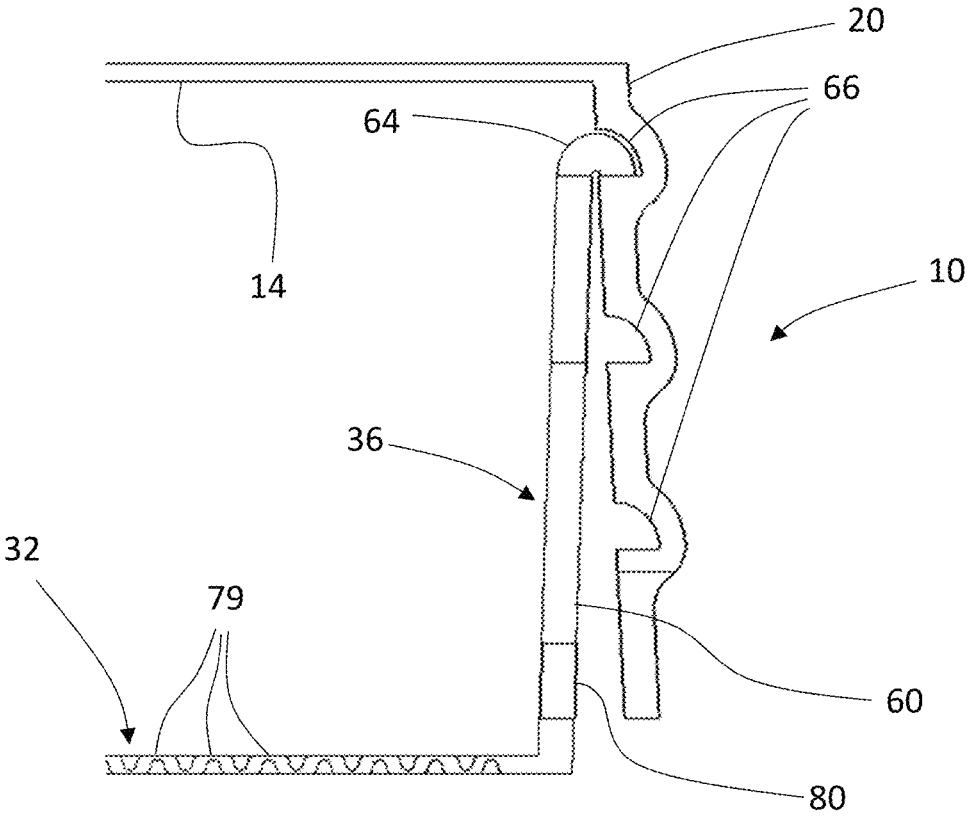
FIGS. 10A-B and 11A-B show optional features of the transport assembly of FIGS. 6, 8, and 9.
Figure 10B:
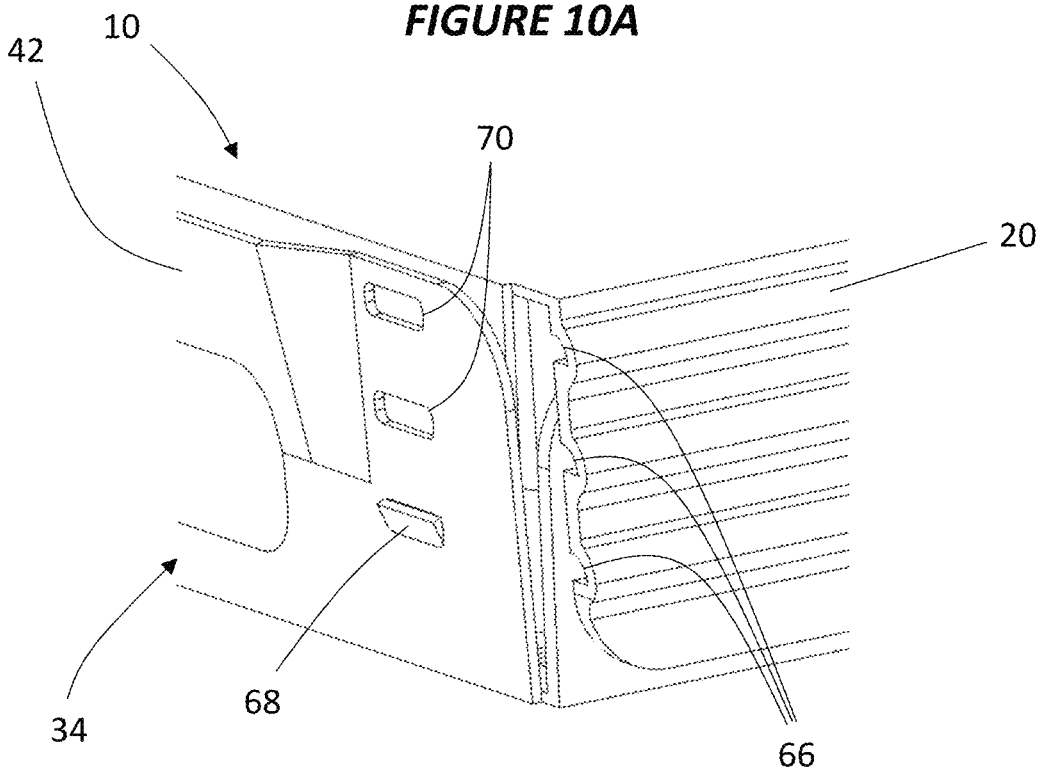

As shown in FIG. 10A, the outer surface 60 of each drawer side 36 can include a hook 64. The inner side surface of the box side 20 can include one or more indentations 66 that are configured to releasably engage the hook 64. In the illustrated example, the box side 20 includes three indentations 66 that are spaced along a height of the box side 20. The multiple indentations 66 allow the overall height of the transport assembly 10 to be adjusted based on the vials stored in the transport assembly. For example, the hook 64 is engaged with the topmost indentation 66 in FIG. 10A. In FIG. 11A, the hook 64 is engaged with the bottommost indentation 66, which increases the overall height of the transport assembly 10 relative to FIG. 10A. FIGS. 10B and 11B each show a partial perspective view of the transport assembly 10 when the hook 64 is engaged with the respective indentation 66.

In some instances, the height of the indentations 66 can be adapted to specific vial sizes so that the box surface 14 and the drawer surface 32 can clamp a variety of vial sizes between them. Clamping the vials (not shown) between the box surface 14 and the drawer surface 32 may further secure the vials, as well as decrease the overall size of the transport assembly 10. In some instances, the box surface 14 may also include a textured or corrugated pattern 67 (FIG. 1). The pattern may prevent damage to the vials, facilitate sliding of the vials during unloading, increase the stiffness of the box portion 12, for example. Rather than a textured or corrugated pattern 67, the box surface 14 may also have a smooth coating 14 (FIG. 1) to improve the sliding properties of the vials during unloading.

Similarly, the drawer surface 32 can also include a textured pattern. In some cases, the pattern may create a passage for the sterilization gas to flow under the bottom of the vials. For example, FIGS. 10A and 11A show longitudinal ridges 79 in the drawer surface 38 that may facilitate the flow of gaseous sterilant around the vials (not shown). In addition, apertures 80 may be formed in the drawer sides 36 to allow gaseous sterilant to flow into the transport assembly 10. The apertures 80 may be provided close to the drawer surface 32 to reduce potential obstruction by the box side 20 when the box portion 12 and the drawer portion 30 are coupled (FIGS. 11A and 11B).

As shown in FIGS. 2 and 12, the hook 64 can extend along substantially the entire length of the respective drawer side 36. In some instances, the hook 64 may include multiple hook portions that are arranged in discrete intervals along the length of the respective drawer side 36. Since the hook 64 may remain engaged with a respective indentation 66 when the drawer portion 30 is moved in the manner shown in FIG. 8, such a continuous hook 64 may reduce friction between the box portion 12 and the drawer portion 30. In contrast, the indentations 66 may extend substantially along the entire length of the box side 20, as shown in FIG. 6, or may be arranged discontinuously, in intervals, as shown in FIG. 1.

In some instances, the drawer front 34 may also releasably latch to the box front 16. Such a latch may prevent the drawer portion 30 from inadvertently sliding away from the box portion 12 (see FIG. 8). The present disclosure shows two examples of such latches.

As shown in FIG. 10B, the outer surface 58 of the box front 16 can include a hook 68 that releasably engages one or more indentations 70 that are provided in the drawer front 34. The indentations 70 may correspond to the indentations 66 in the box sides to enable the drawer front 34 to latch to the box front 16 at various heights (FIG. 11B). Alternatively, FIG. 7 shows that the tabs 44 provided on the drawer front 34 may extend through the first and second gap sections 24, 26 provided between the box front 16 and the box sides 20. In comparison to the arrangement of FIGS. 10A-B and 11A-B, the arrangement of FIG. 7 may be continuously adjustable in terms of height.

Figure 13:
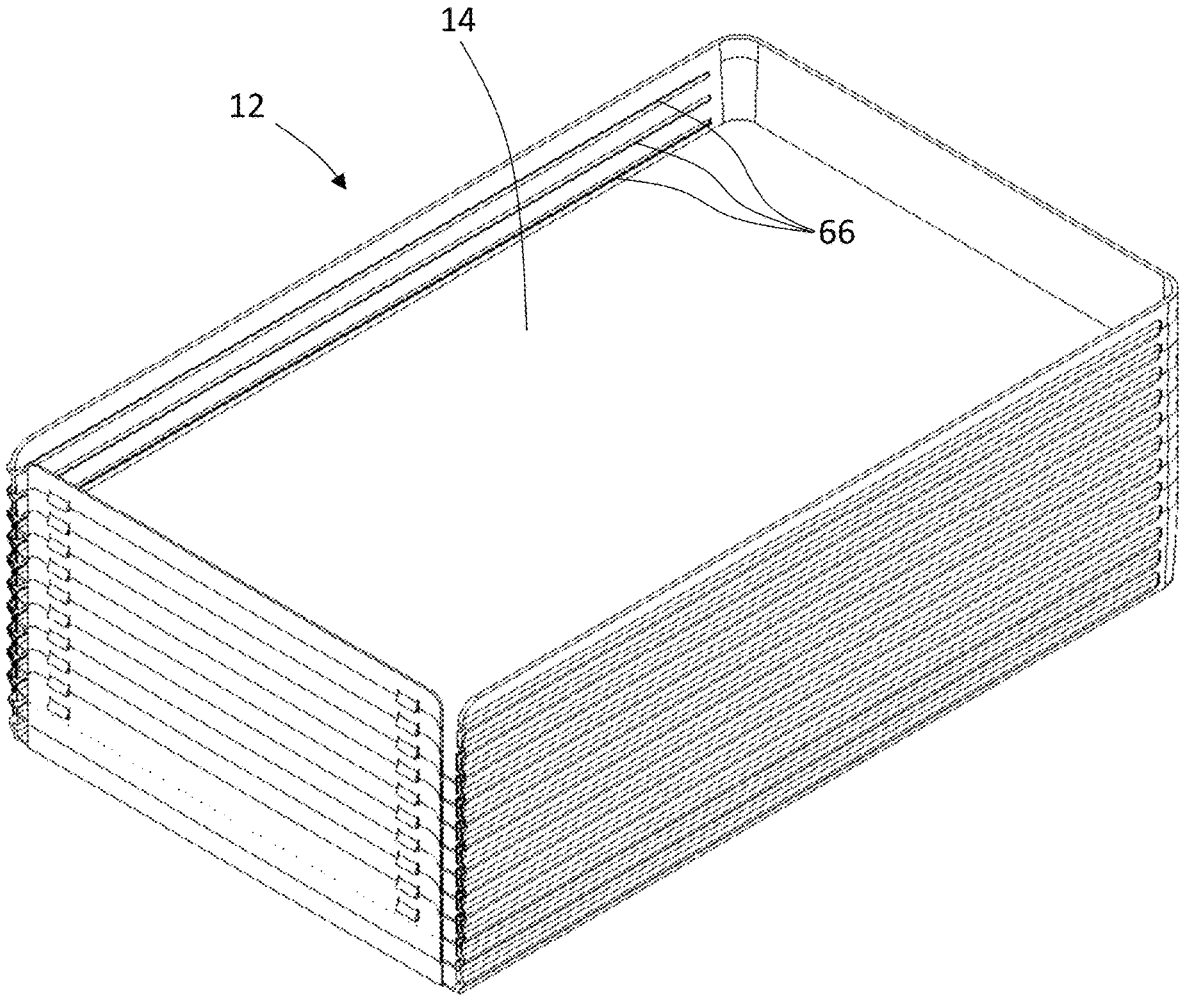
FIG. 13 shows a stack of box portions.

Further, as shown in FIG. 10A, the box sides 20 and the drawer sides 36 may each form an obtuse angle to the box surface 14 and the drawer surface 32, respectively. Such obtuse angles may allow the box portions 12 and the drawer portions 30 to be stacked, as shown in FIGS. 12 and 13. Stacking the box portions 12 and the drawer portions 30 may be useful when the transport assembly 10 is designed to be reused. The box front 16 and box sides 18 may also form an obtuse angle relative to the box surface 14. Likewise, the drawer front 34 may also form an obtuse angle relative to the drawer surface 32.

Figure 14:
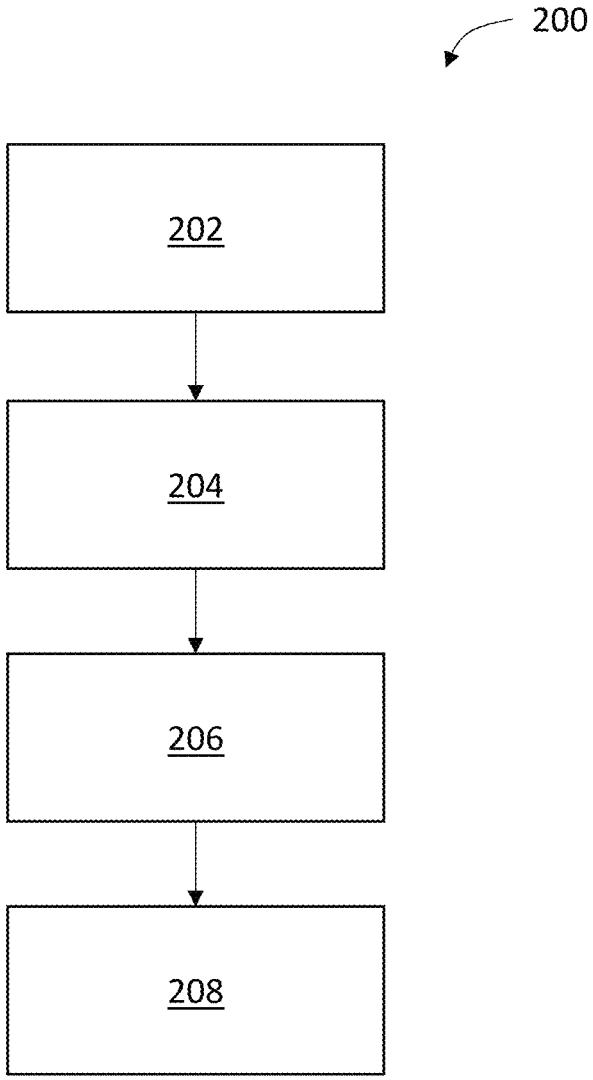
FIG. 14 is a schematic overview of a method according to the present disclosure.

FIG. 14 is a schematic overview of a method 200 according to the present disclosure. The method 200 may be implemented, e.g., using any of the transport assemblies 10 described above.

The method 200 includes receiving 202 a box portion that includes a box surface, a box front, a box back, and a pair of box sides. The box front, the box back, and the box sides each extend from the box surface, and a front gap extends between the box front and each of the box sides. The method 200 further includes arranging 204 a plurality of packaging units in the box portion. The method 200 further includes receiving 206 a drawer portion that includes a drawer surface, a drawer front, and a pair of drawer sides. The drawer front and the drawer sides each extend from the drawer surface, and the drawer surface and drawer sides define an open back portion that faces the drawer front. A drawer gap extends between the drawer front and each of the drawer sides. The method 200 further includes arranging 208 the drawer portion relative to the box portion such that an inner surface of the drawer front faces an outer surface of the box front and an inner surface of each box side faces an outer surface of a corresponding drawer side.

Arranging 208 the plurality of packaging units in the box portion may include receiving an insert that defines a plurality of openings, each opening configured to receive a respective container and having a substantially hexagonal opening; laying the insert inside the box portion; and arranging one of the plurality of packaging units in each insert opening.

The method may 200 include placing drawer surface on a supported surface; sliding the drawer portion away from the box portion while the box portion is held in place; and lifting the box portion, and optionally the insert, from the plurality of packaging units.

A number of embodiments have been described. Nevertheless, numerous alternative embodiments within the scope of the claims will be readily appreciated by those skilled in the art. The presently described embodiments are not to be taken as limiting the scope of the invention.

The invention claimed is:

1. A transport assembly comprising:

a box portion that comprises a box surface, a box front, a box back, and a pair of box sides, wherein the box front, the box back, and the box sides each extend from the box surface, wherein a gap extends between the box front and each of the box sides; and a drawer portion that comprises a drawer surface, a drawer front, and a pair of drawer sides, wherein the drawer front and the drawer sides each extend from the drawer surface, wherein the drawer surface and drawer sides define an open back portion that faces the drawer front, wherein a gap extends between the drawer front and each of the drawer sides, wherein the box portion and the drawer portion can be arranged such that an inner surface of the drawer front faces an outer surface of the box front, the drawer front releasably latches to the box front, and an inner surface of each box side faces an outer surface of a corresponding drawer side.

2. The transport assembly according to claim 1, wherein each box side releasably latches to a corresponding drawer side.

3. The transport assembly according to claim 2, wherein the outer surface of each drawer side comprises one or more hooks, and wherein the inner surface of each box side comprises one or more indentations configured to releasably engage the one or more hooks.

4. The transport assembly according to claim 3, wherein the hook extends along a length of the drawer side.

5. The transport assembly according to claim 3, wherein each box side comprises a plurality of indentations that are spaced along a height of the box side.

6. The transport assembly according to claim 1, wherein the outer surface of the box front comprises a hook, and wherein the inner surface of the drawer front comprises one or more indentations configured to releasably engage the hook, wherein the inner surface of the drawer front optionally comprises a plurality of indentations that are spaced along a height of the drawer front.

7. The transport assembly according to claim 1, wherein the drawer front comprises two or more tabs that releasably engage the gap that extends between the box front and each of the box sides.

8. The transport assembly according to claim 1, wherein the box front, the box back, and the box sides each form an obtuse angle relative to the box surface.

9. The transport assembly according to claim 1, wherein the drawer front and the drawer sides each form an obtuse angle relative to the drawer surface.

10. The transport assembly according to claim 1, further comprising an insert that defines a plurality of openings, each opening configured to receive a packaging unit.

11. The transport assembly according to claim 10, wherein each insert opening has a substantially hexagonal shape, wherein the insert optionally comprises a flexible material and is configured to expand and collapse.

12. The transport assembly according to claim 10, wherein each insert opening has a substantially hexagonal shape, wherein the insert optionally comprises a flexible material and is configured to expand and collapse.

13. The transport assembly according to claim 1, wherein the drawer surface comprises one or more ridges that substantially extend along the length of the drawer surface.

14. The transport assembly according to claim 1, wherein one or both drawer sides includes one or more apertures that extend through a thickness of the drawer side and are arranged adjacent to the drawer surface.

15. The transport assembly according to claim 1, further comprising an insert that defines a plurality of openings, each opening configured to receive a packaging unit.

16. The transport assembly according to claim 15, wherein each insert opening has a substantially hexagonal shape, wherein the insert optionally comprises a flexible material and is configured to expand and collapse.

17. A transport assembly comprising:

a box portion that comprises a box surface, a box front, a box back, and a pair of box sides, wherein the box front, the box back, and the box sides each extend from the box surface, wherein a gap extends between the box front and each of the box sides, and the box front, the box back, and the box sides each form an obtuse angle relative to the box surface;

a drawer portion that comprises a drawer surface, a drawer front, and a pair of drawer sides, wherein the drawer front and the drawer sides each extend from the drawer surface, wherein the drawer surface and drawer sides define an open back portion that faces the drawer front, wherein a gap extends between the drawer front and each of the drawer sides; and an insert that defines a plurality of openings, each opening configured to receive a packaging unit, wherein the box portion and the drawer portion can be arranged such that an inner surface of the drawer front faces an outer surface of the box front, and an inner surface of each box side faces an outer surface of a corresponding drawer side.

18. A transport assembly comprising:

a box portion that comprises a box surface, a box front, a box back, and a pair of box sides, wherein the box front, the box back, and the box sides each extend from the box surface, wherein a gap extends between the box front and each of the box sides, and the box front, the box back, and the box sides each form an obtuse angle relative to the box surface; and a drawer portion that comprises a drawer surface, a drawer front, and a pair of drawer sides, wherein the drawer front and the drawer sides each extend from the drawer surface, wherein the drawer surface and drawer sides define an open back portion that faces the drawer front, wherein a gap extends between the drawer front and each of the drawer sides, wherein the box portion and the drawer portion can be arranged such that an inner surface of the drawer front faces an outer surface of the box front, and an inner surface of each box side faces an outer surface of a corresponding drawer side.

19. The transport assembly of claim 18, wherein the drawer front and the drawer sides each form an obtuse angle relative to the drawer surface.

20. A transport assembly comprising:

a box portion that comprises a box surface, a box front, a box back, and a pair of box sides, wherein the box front, the box back, and the box sides each extend from the box surface, wherein a gap extends between the box front and each of the box sides; and a drawer portion that comprises a drawer surface, a drawer front, and a pair of drawer sides, wherein the drawer front and the drawer sides each extend from the drawer surface, wherein the drawer surface and drawer sides define an open back portion that faces the drawer front, wherein a gap extends between the drawer front and each of the drawer sides, and the drawer front and the drawer sides each form an obtuse angle relative to the drawer surface, wherein the box portion and the drawer portion can be arranged such that an inner surface of the drawer front faces an outer surface of the box front and an inner surface of each box side faces an outer surface of a corresponding drawer side.

* * * * *